United States Patent [19]

Wilkening

[11] Patent Number: 4,919,771

[45] Date of Patent: Apr. 24, 1990

[54] PROCESS FOR PRODUCING ALUMINUM BY MOLTEN SALT ELECTROLYSIS

[75] Inventor: Siegfried Wilkening, Alfter-Oedekoven, Fed. Rep. of Germany

[73] Assignee: VAW Vereinigte Aluminium-Werke AG, Bonn, Fed. Rep. of Germany

[21] Appl. No.: 143,139

[22] PCT Filed: Jan. 24, 1979

[86] PCT No.: PCT/DE79/00007

§ 371 Date: Oct. 9, 1979

§ 102(e) Date: Sep. 20, 1979

[87] PCT Pub. No.: WO79/00606

PCT Pub. Date: Aug. 23, 1979

[30] Foreign Application Priority Data

Feb. 9, 1978 [DE] Fed. Rep. of Germany ..... 2805374

[51] Int. Cl.[5] ..... C25C 3/06

[52] U.S. Cl. ..... 204/67; 204/294

[58] Field of Search ..... 204/67, 243 R, 291, 204/294, 283; 252/508

[56] References Cited

U.S. PATENT DOCUMENTS

| | | | |
|---|---|---|---|
| 503,929 | 8/1893 | Hall | 204/67 |
| 3,009,863 | 11/1961 | Angevine | 204/294 |
| 4,049,511 | 9/1977 | Alder et al. | 204/67 |
| 4,115,215 | 9/1978 | Das et al. | 204/67 |
| 4,118,292 | 10/1978 | Fray et al. | 204/67 |

FOREIGN PATENT DOCUMENTS

| | | | |
|---|---|---|---|
| 4087 | of 1879 | United Kingdom | 204/67 |
| 2888 | of 1883 | United Kingdom | 204/67 |
| 16794 | of 1889 | United Kingdom | 204/67 |
| 309605 | 7/1930 | United Kingdom | 204/67 |
| 483068 | 9/1935 | United Kingdom | 204/67 |
| 511076 | 8/1939 | United Kingdom | 204/67 |

*Primary Examiner*—John F. Niebling
*Assistant Examiner*—Kathryn Gorgos
*Attorney, Agent, or Firm*—Darby & Darby

[57] ABSTRACT

The invention concerns a process for producing aluminum by molten salt electrolysis, whereby a melt consisting of alkali halides and/or alkali earth halides is used as electrolyte and a mixture containing aluminum oxide and carbon is used as the anode.

8 Claims, 7 Drawing Sheets

PROCESS FOR PRODUCING ALUMINUM BY MOLTEN SALT ELECTROLYSIS

There are essentially two processes known for the production of aluminium by molten salt electrolysis.

The first of these processes is based on the electrolysis of aluminium oxide, which is dissolved in molten cryolite at temperatures of 950°-970° C. Apart from cryolite, no other substance has yet been found in which aluminium oxide is sufficiently soluble to enable aluminium to be produced by electrolysis below 1000° C. In electrolytic cells run under technical operating conditions, the aluminium oxide content varies between approx. 2% and 8% by weight. If the aluminium oxide content in the cryolite melt is too low, e.g. less than 1-2%, the so-called anode effect occurs at the anode, which manifests itself as an increase of the cell voltage to several times normal value. The anode and cathode are of carbon. The oxygen set free by the decomposition of the aluminium oxide combines with the carbon of the anode to form carbon dioxide and carbon monoxide. In the case of prebaked carbon, electrodes are consumed approximately 0.43 to 0.5 kg of carbon per kg of aluminium produced.

The second process concerns the molten salt electrolysis of aluminum chloride. Since aluminium chloride sublimes at 183° and is poor ionic conductor, it is usually dissolved in molten alkali chlorides. In order to be able to separate the aluminium in liquid form, electrolysis temperatures of approx. 700° C. are chosen. The material principally used for the anode and cathode is graphite. Gaseous chlorine is released at the graphite anode. Several processes have been suggested for carrying out the electrolysis of aluminium chloride.

The electrolysis of aluminium chloride is beset with many difficulties. The collection and leading away of the gaseous chlorine at the node at approximately 700° C. is a problem of construction materials. The vapor pressure of the aluminium chloride dissolved in the molten salt is relatively high, so that in drawing off the chlorine gas noticeable quantities of aluminium chloride are also taken out from the cell. As the concentration of aluminium chloride in the melt increases, the electrical conductivity decreases. It is likewise difficult to feed the aluminium chloride, which is in the form of a gas, into the melt. Experience shows that the aluminium chloride and the melt must be free of oxidic impurities, since the decomposition of the oxides causes the carbon of the graphite anodes to be consumed and their life to be reduced. A particular disadvantage is, however, that no simple way has yet succeeded in producing pure aluminium chloride directly by reductive chlorination of the aluminium ores, e.g. bauxite. It has, therefore, been suggested that initially pure aluminium oxide should be produced by means of the known Bayer process, and that this be subsequently converted to aluminium chloride and carbon dioxide using chlorine and carbon or carbonyl chloride (phosgene).

The process described above does lead to pure aluminium, but the process contains an additional stage and is correspondingly more costly.

The task of the invention here presented is to produce aluminium by electrolysis using an electrolyte consisting mainly of chlorides. Thereby not only are the deficiencies described above of the aluminium chloride electrolysis and aluminium oxide electrolysis processes avoided, but in addition the manufacture of aluminium chloride as a raw material for the process is also avoided.

BRIEF DESCRIPTION OF THE DRAWINGS

The invention will be further described with respect to the accompanying drawings wherein.

Figure 1:
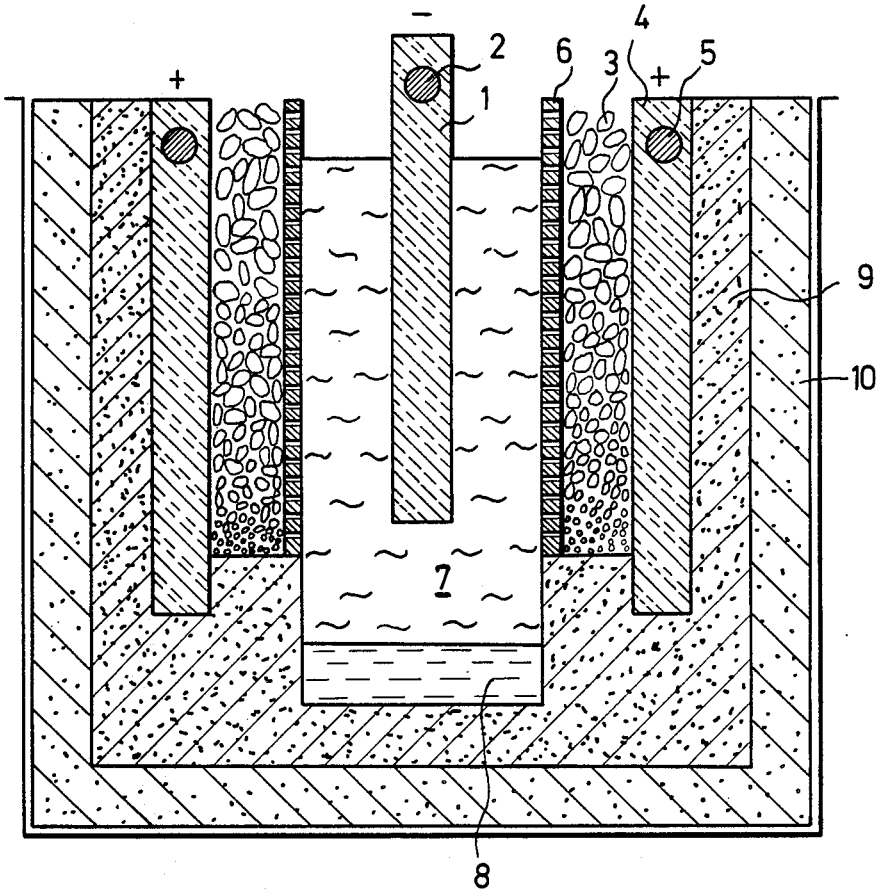
FIG. 1 is a section through an electrolytic cell of the present invention.

It was found that by electrolyzing in a melt consisting of alkali chlorides using an anode composed of a mixture of aluminium oxide and carbon, aluminium is produced at the cathode at a relatively good current efficiency without either chlorine or aluminium chloride being released at the anode. The preferred temperatures for this electrolysis are 680° to 850° C. The main component of the molten salt is sodium chloride with additions of potassium chloride, lithium chloride or alkaline earth chlorides. An addition of from 10-40% of cryolite or other alkali fluorides, alkali earth fluorides or light metal fluorides is advisable, to permit the aluminium, by reason of the lower surface tension to the salt melt, to coalesce more easily. It is also desirable to start the electrolysis with a low content 3.5% of $AlCl_3$ in the melt, since otherwise a primary decomposition of alkali chloride occurs initially.

Electro-graphite (also called synthetic graphite) and titanium diboride have proven themselves well as materials for the bottom and the side walls of the electrolysis cell. It depends on the design of the electrolysis cell whether the side walls of the cell, when for instance bipolar electrodes are used, should be partially lined with a ceramic, electrically non-conductive product such as magnesite, or corundum. A preferred range for the anode current density is 0.1-2 amperes per square centimeter.

The novel and surprising feature of the invention here described is that the reducing chlorination of the aluminium oxide at the anode and the electrolytic decomposition of the aluminium chloride thus formed proceed simultaneously and in stochiometric proportions. Despite a very low oxide content in the electrolytic melt, the anode effect phenomenon mentioned above was not observed to occur even with the anode current density increased to higher than normal.

In comparison with the two commonly known electrolytic processes, that is the electrolysis of $AlCl_3$ and the electrolysis of $Al_2O_3$ in cryolite, the following advantages can be listed for the process described for this invention: No handling or movement of chlorine or aluminium chloride are required. Chlorine is a very corrosive gas, particularly when it has to be collected at approximately 700° C. in the $AlCl_3$ electrolytic cell. Aluminium chloride is hygroscopic and is split hydrolytically into hydroxide and hydrochloric acid under the influence of atmospheric water vapour; as a sublimate it occupies a large volume. Contact with aluminium chloride and with chlorine requires enclosed, corrosion-resistant equipment. This results in high capital, operating and repair costs.

Furthermore, the concentration of the aluninium chloride occurring as an intermediate product in the melt is at a very low level, so that neither its vapour pressure not its adverse influence on the electrical conductivity are noticeable.

At the anode an anode gas consisting of carbon dioxide and carbon monoxide is formed, in a similar way to that in the aluninium electrolytic process in the cryolite melt. While, however, the known process of aluminium electrolysis in cryolite takes place at bath temperatures of around 950° C., for the electrolysis using an aluminium-carbon-anode in a melt consisting predominantly of chlorides a working temperature of 850° at maximum, and of 750° on the average, is adequate. The lower electrolysis temperatures reduce the heat losses and the specific energy consumption. The electrolytic cell which is the subject of the invention requires to be supplied as raw material only with the compact aluminium oxide/carbon anode, which can be fed either discontinously in the form of blocks or continuously in the form of a strand. In contrast to this, when carrying out the electrolysis using a cryolite melt containing $Al_2O_3$, the $Al_2O_3$ concentration in the electrolytic bath must be maintained by breaking the surface crust at predetermined intervals and feeding more aluminium oxide in. The only service operations required in the process which is the subject of the invention are to replace the anodes and to sucking out the aluminium produced. The process allows the electrolytic cell to be fully enclosed in a simple surrounding casing which does not need to be opened often.

The anode of aluminium oxide and carbon to be used, which forms part of the invention, presented several problems whose solution was an important task.

The anode should theoretically consist of 85% aluminium oxide and 15% carbon, if carbon dioxide is produced as a reaction product from the electrochemical reaction. To produce carbon monoxide there would be required an anode with 74% $Al_2O_3$ and 25% C. Because of the Boudouard equilibrium, it is not, however, possible to produce pure carbon monoxide at temperatures in the region of 750° C., but only a gaseous mixture of CO and $CO_2$ with approximately 80% of CO. Thus, on a theoretical basis, the ratio of aluminium oxide to carbon may lie between the limits 5.66:1 and 3.4:1. Departures from 100% current efficiency and a very slight burn-off of the anodes by air increase the consumption of carbon. Under practical conditions of electrolysis, the gas developed at the anode is predominantly carbon dioxide. The ratio by weight of $Al_2O_3$ to C in the anode can vary in a range between 5:1 and 3:1 without observing any serious disturbances to the process of electrolysis. The self-adjustment of the ratio of $CO_2$:CO in the anode gas has a regulatory effect. In the tests carried out it was aimed to achieve an appropriate composition of 80% $Al_2O_3$ and 20% C, that is a ratio of 4:1 by weight.

The proportion by volume of the carbon in the $Al_2O_3$/C anode is, however, greater, since the true density of the carbon is approx. 2.00 g/cm$^3$ and that of the aluminium oxide approx. 3.8 g/cm$^3$. From this, it can be calculated that the ratio of 4:1 by weight given above corresponds to a proportion of 32.2% carbon by volume.

An anode of aluminium oxide and carbon can for example be manufactured by mixing finely divided aluminium oxide and/or aluminium hydroxide with electrode pitch, shaping this mixture into a solid body and then firing it under the exclusion of air by using a slow heating rate to about 1000° C. The fired aluminium oxide/carbon has an electrical resistivity of aproximately 1000 ohm mm$^2$/m. A carbon anode, as used for the electrolysis of $Al_2O_3$ in molten cryolite, has a resistivity of only approximately 60 ohm mm$^2$/m. The $Al_2O_3$/C anode is, therefore, not suitable for long electrical paths in the anode. To keep the voltage drop in the anode as low as possible, it is helpful to the process which is the subject of this invention to combine the $Al_2O_3$/C anode with an auxiliary conductor of graphite. The electrical resistivity of the graphite is in the region of 10 ohm mm$^2$/m, that is one-sixth of that of a fired carbon anode. The graphite material can be loaded to current densities of up to 10 A/cm$^2$. If anode current densities of at least 0.6–1.0 A/cm$^2$ are to be reached, as commonly used in the electrolysis of $Al_2O_3$ with a carbon anode in a cryolite melt, it is sufficient to provide a conductor cross-section of the electrical graphite of about one-fifth of the cross-section of the $Al_2O_3$/C anode. The composite anode of the $Al_2O_3$/C body and the graphite material can then be loaded to a similar extent as a carbon anode without fear of overheating or of unfavorable power consumption. The graphite material, which is a good conductor, is connected largely in parallel to the $Al_2O_3$/C body. This can be achieved for instance by locating the graphite in slab or rod form in the core of the $Al_2O_3$/C body, or by forming an envelope of the graphite around the outside of the $Al_2O_3$/C body.

Surprisingly, it has been found that auxiliary conductor of synthetic graphite installed beside the $Al_2O_3$/C material in the electrolytic cell is not itself consumed in the process. The synthetic graphite can, therefore, be re-used as a carrier for the $Al_2O_3$/C material.

To manufacture an electrically conductive, solid, shaped body from aluminium oxide and pitch, firing in a deep-chamber annular kiln is used: this processing stage has an unsatisfactory yield with respect to space and time. In further extension of the invention, this production step can be avoided by making a self-baking Söderberg paste with the aid of suitable sorts of tar or pitch. It is sensible here to either embed the conductive auxiliary material consisting of graphite elements in the mixture of $Al_2O_3$ and pitch, or to surround the $Al_2O_3$/-pitch mixture with the graphite. As the consumption of the anode in the electrolytic cell proceeds, the $Al_2O_3$/-pitch material comes into increasingly higher zones of temperature, by which it is gradually coked and bonded both electrically and mechanically to the graphite. The metallic current leads leading to the anode are, in the interests of a low contact resistance or transition resistance, connected to the graphite elements. The metallic contact-pieces and their mountings are designed in such a way that they can be automatically and continuously shifted.

In a Söderberg paste of aluminium oxide and pitch, it is also possible to use aluminium for the auxiliary conductor in place of graphite. It is true that the aluminium melts at around 650° C., that is approximately 100° below the electrolysis temperature, but between 550° and 650° C. a transfer of electrical current from the aluminium to the $Al_2O_3$/C material is possible.

The gases released in and at the anode are completely collected by fully encapsulating the electrolytic cell, are sucked off and fed to a waste-gas cleaning system. The losses of chlorine and salts from the molten salt electrolyte, which cannot be completely avoided, are compensated by adding a molten salt mixture of aluminium chloride and the salt components of the cell, which is melted elsewhere and then added as required.

Having described above the basic principles of the process which is the subject of the invention, three electrolysis units working on this principle will now be described.

FIG. 1 shows a section through an electrolytic cell with only a single replaceable composite anode. The current leading steel bars (2) are inserted in the cathode (1) made up of synthetic graphite or some other carbon material. A layer of liquid aluminium (3) lies on the bottom of the cathode compartment. Above the cell is filled with the electrolyte melt (4). The carbon cathode (1) is surrounded by thermally insulating brickwork (5). The steel shell (6) forms the outer frame of the electrolysis vessel. The discontinuous composite anode (7/8) consists of the $Al_2O_3$/carbon material (7) and of the graphite part (8). The anode, immersed in the molten salt (4), is held by the metal rod (9). The metal rod (9) also serving as a current feed conductor, is screwed into the graphite part (8) and is electrically fastened, above the electrolytic cell, to a current feed bar. To prevent any corrosion of the metal rod within the cell, it is surrounded by a protective sleeve (10). The electrolytic cell is covered by the sheet metal hood (11). The gases produced during electrolysis are sucked off through the openings (12) to which a pipeline is connected.

Figure 2:
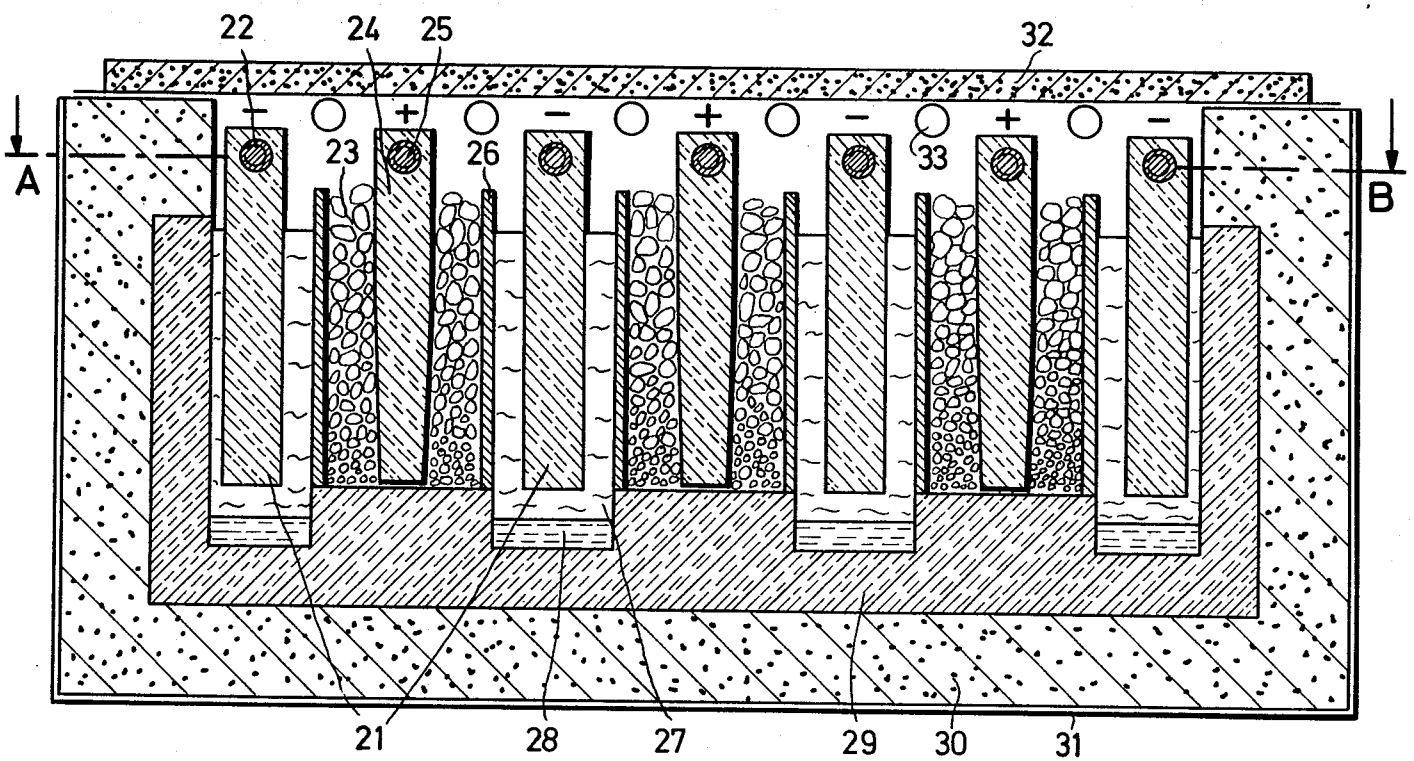
FIG. 2 illustrates a longitudinal section through a multi-chamber electrolytic cell of the present invention.

FIG. 2 illustrates a longitudinal section through a multi-chamber electrolytic cell. The electrolysis unit contains a series of graphite cathodes in the form of plates (21) which are connected in parallel and are suspended in the rectangular electrolysis chamber by means of the current feed bolts (22) which are screwed into them. The anodes (23, 24) are arranged between the cathodes, which as also in FIG. 1, consist of the aluminium oxide/carbon material 23 and the carrier plates of graphite (24). Current feed bolts (25) coming from the side are also supplied to support the anodes, whose $Al_2O_3$/C material dips into the electrolyte (26). The layer of aluminium (27) on the bottom of the electrolysis cell spreads through all the chambers. A lining of carbon slabs is in contact with both the aluminium (27) and the electrolyte (26). Behind this lining material (28) there are first a ceramic thermal insulation layer (29) and then the steel vessel (30). The electrolytic cell is closed by means of the cover plate (31). Not illustrated is the fact that this cover is provided with flaps, through which the anodes (23,24) can be exchanged. The waste gases are sucked off through the outlet holes (32).

Figure 3:
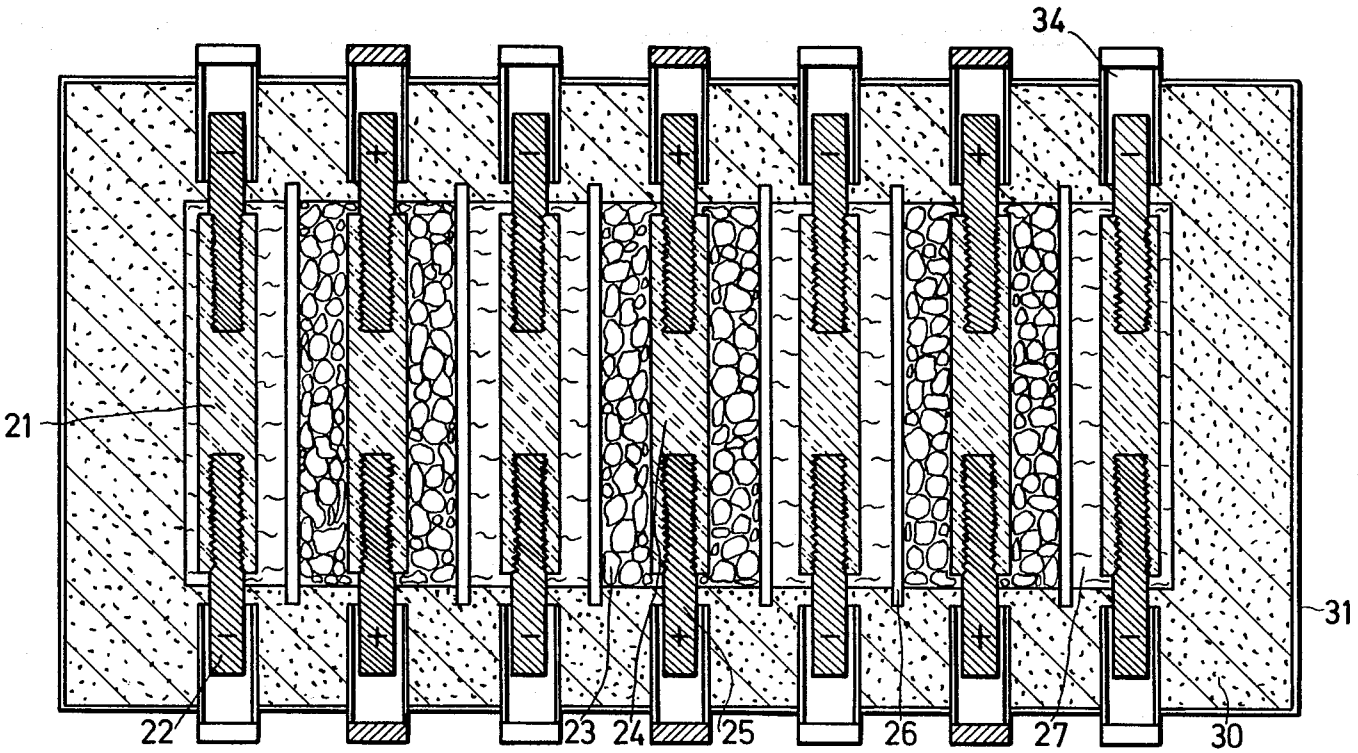
FIG. 3 is a horizontal section through the plane (A-B) of the electrolytic cell depicted in FIG. 2.

FIG. 3 is a horizontal section through the plane AB of the electrolytic cell depicted in FIG. 2. As additional explanation, it can be seen in this section that the current feed bolts to the anode and cathode elements (22 and 25) are located in hemispherical contact shells (33), which are connected outside the vessel to the corresponding positive and negative current bus bars. Apart from this, the identification numbers used in the FIG. 3 are identical to those used for FIG. 2.

The electrolytic cell depicted in FIGS. 2 and 3 can of course contain a larger number of anode and cathode elements (as many as desired) than shown in the example given here. In operating such an electrolytic cell, care must be taken to ensure that the state of consumption of the $Al_2P_3$/C material (23) of the individual anodes is not equal. When the $Al_2O_3$/C material (23) on one of the anode carrier plates (24) is fully consumed, the anode element must be exchanged by a new one. While this anode is being replaced, its current flow is taken over by the other anode elements which are connected in parallel. The aluminium produced is sucked out from the electrolytic cell into a vacuum crucible with snout in the commonly known way.

Figure 4:
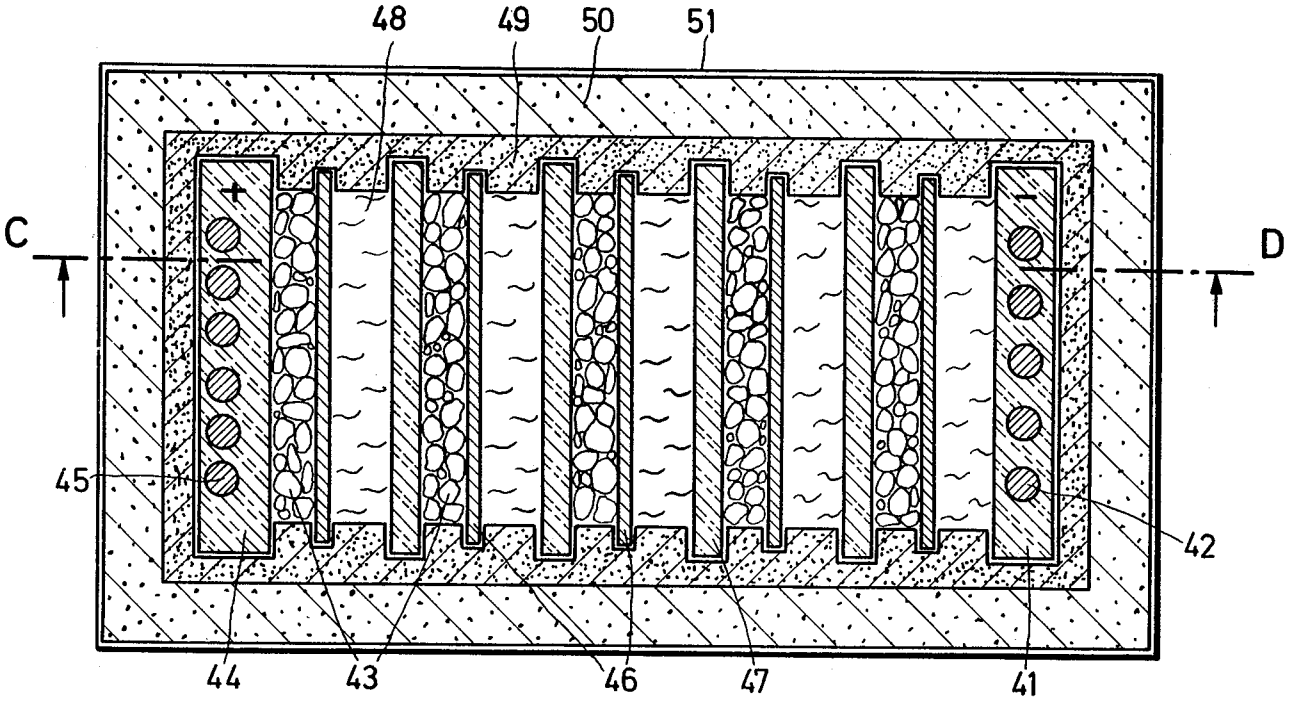
FIG. 4 is a horizontal section of a five cell assembly or battery according to the present invention.
Figure 5:
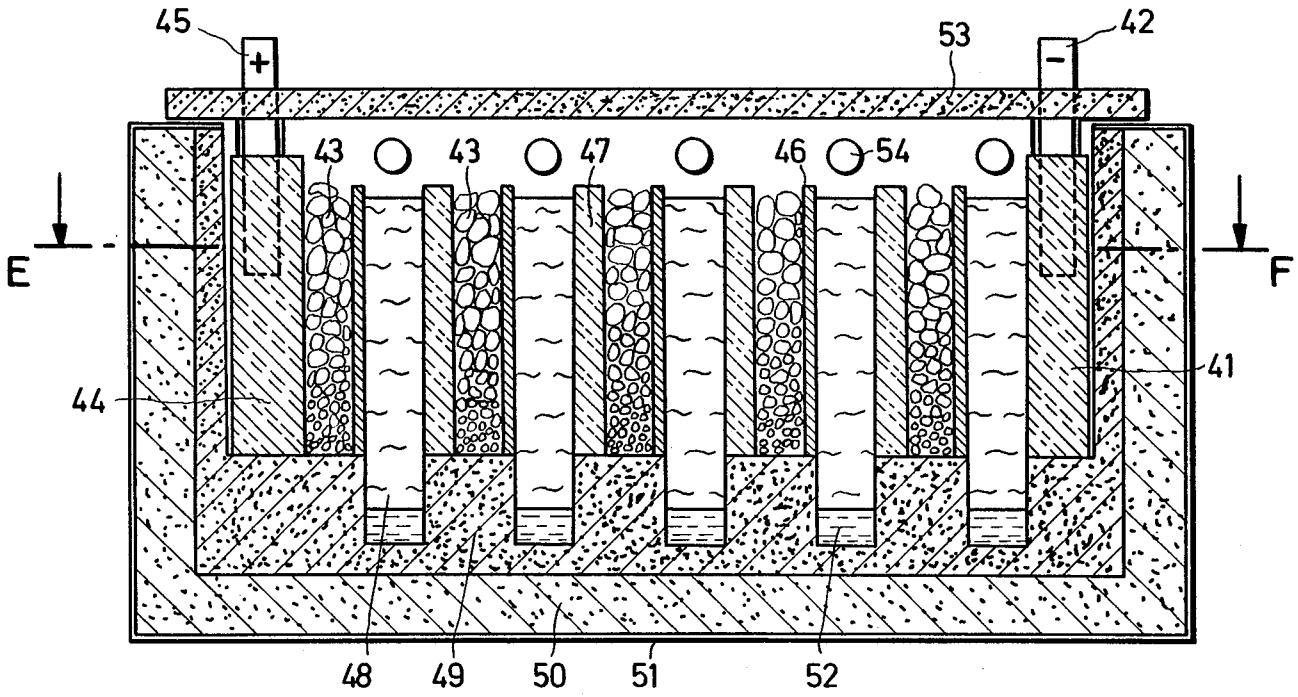
FIG. 5 shows a vertical section through the plane (C-D) shown in FIG. 4.

The process which is subject of this invention can also be achieved in a series of electrolytic cells containing bipolar electrodes and being assembled in one unit. FIGS. 4 and 5 show one example of a five cell assembly or battery. FIG. 4 shows a horizontal section of the equipment shown in FIG. 5, at the height EF, and FIG. 5 shows a vertical section, through the section plane CD, of the equipment shown in FIG. 4. The individual numbers denote as follows: 42=graphite cathode, 42=metal bolts feeding current to cathode, 43=$Al_2O_3$/C material of the bipolar electrode, 44=anode of graphite, 45=metal bolts feeding current to anode, 46=bipolar electrodes, 47=graphite plate of the bipolar electrode, 48=molten salt electrolyte, 49=corrosion-resistant electrically-insulating cladding material, 50=ceramic thermal insulation, 51=steel vessel, 52=liquid aluminium, 53=cover of the electrolytic cell, 54=outlet holes for waste gas.

The cathode (41) the anode (44) and the bipolar electrodes (46) are, as can be seen from FIGS. 4 and 5, placed loose in the electrolysis space in the positions provided for them. The cathode (41) showing only little wear, can remain in the electrolytic cell for long periods. The bipolar electrodes must be replaced when the thickness of the layer of $Al_2O_3$/C material is almost consumed. The $Al_2O_3$/C material (43) on the graphite plates cannot, in contrast to the case for the cell design shown in FIGS. 2 and 3, be permitted to be consumed completely when using bipolar electrodes, because chlorine is deliberated and the alkali chlorides are decomposed. When the $Al_2O_3$/C material (43) on the anode (44) is almost used up and the anode has to be replaced, the current in the electrolytic cell must be interrupted to carry this out. An interruption of the current can however be avoided by dividing the anode into at least two sections, which sections can then be replaced at different times. Such a division is also advisable for the bipolar electrodes, which are then also replaced at differing times. In this way, the $Al_2O_3$/C material on the bipolar electrodes can be almost completely used up.

The materials usually applied for the cathode are carbon, electro-graphite, titanium boride, zirconium boride or mixtures of these substances.

In further extension of the invention, it is possible to use an anode in which the material composed of aluminium oxide and carbon is not mechanically tightly rigidly connected to the graphite part of the anode. It is sufficient that there be electrical contact between the $Al_2O_3$/C material and the electrically well-conducting graphite. A practical realization of this principle is presented in FIG. 6.

Figure 6:
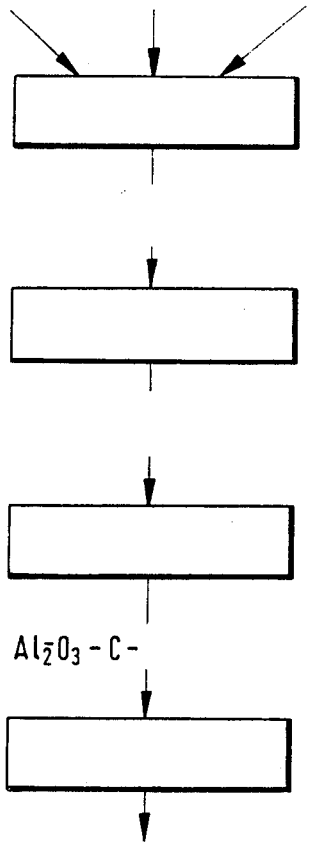
FIG. 6 is a vertical section through another embodiment of an electrolytic cell according to the present invention.

FIG. 6 shows a vertical section through an electrolytic cell which differs from the electrolytic cells described in FIGS. 1 to 5 in the construction of the anode and in the feeding in of the $Al_2O_3$/C material. The cathode (61) of graphite with the metallic current lead (62) is arranged in the middle of the electrolytic cell.

The anode is composed of three basic elements. The first component part of the anode is a graphite plate (64) with the bolt (65) by which the current required for the electrolysis is fed to it. The $Al_2O_3/C$ material, in the form of agglomerated material, is placed in front of the graphite plate (64). The $Al_2O_3/C$ material is supplied in the form of briquettes, pellets, tablets or other granular form and is held by a plate (66). In the example presented here the plate (66) consists of graphite and exhibits horizontal slots. However, also, other materials such as sintered corundum, zirconium oxide or sintered magnesia are suitable for the fabrication of plate (66). The plate (66) resembles a diaphragm and has the tasks firstly of preventing any particles of the $Al_2O_3/C$ material from moving from the anode region into the electrolyte region and secondly of permitting adequately free passage for the electrolytic melt (67) which fills the electrolysis room between anode and cathode. Therefore, the plate (66) must either have a system of open pores or must contain holes or channels suitable for this purpose. The aluminium is produced in liquid form at the cathode (61). It drips down from the cathode and collects on the bottom of the electrolytic cell to the bath (68).

The anode (consisting of the component parts (63,64 and 66)) and the remainder of the electrolysis volume are contained within a corrosion-resistant, electrically non-conductive brickwork structure (69). Thermal insulation of the electrolytic cell is provided by the refractory insulation (70).

The feeding in of the agglomerated $Al_2O_3/C$ material can be carried out either in batches or continuously by means of a hopper at a rate matched to the rate of consumption in the cell. A three-component anode can of course also be used in place of the composite anodes 23 and 24 in FIGS. 2 and 3 or of 43 and 44 in FIGS. 4 and 5 for the multi-cell electrolysis unit.

Figure 7:
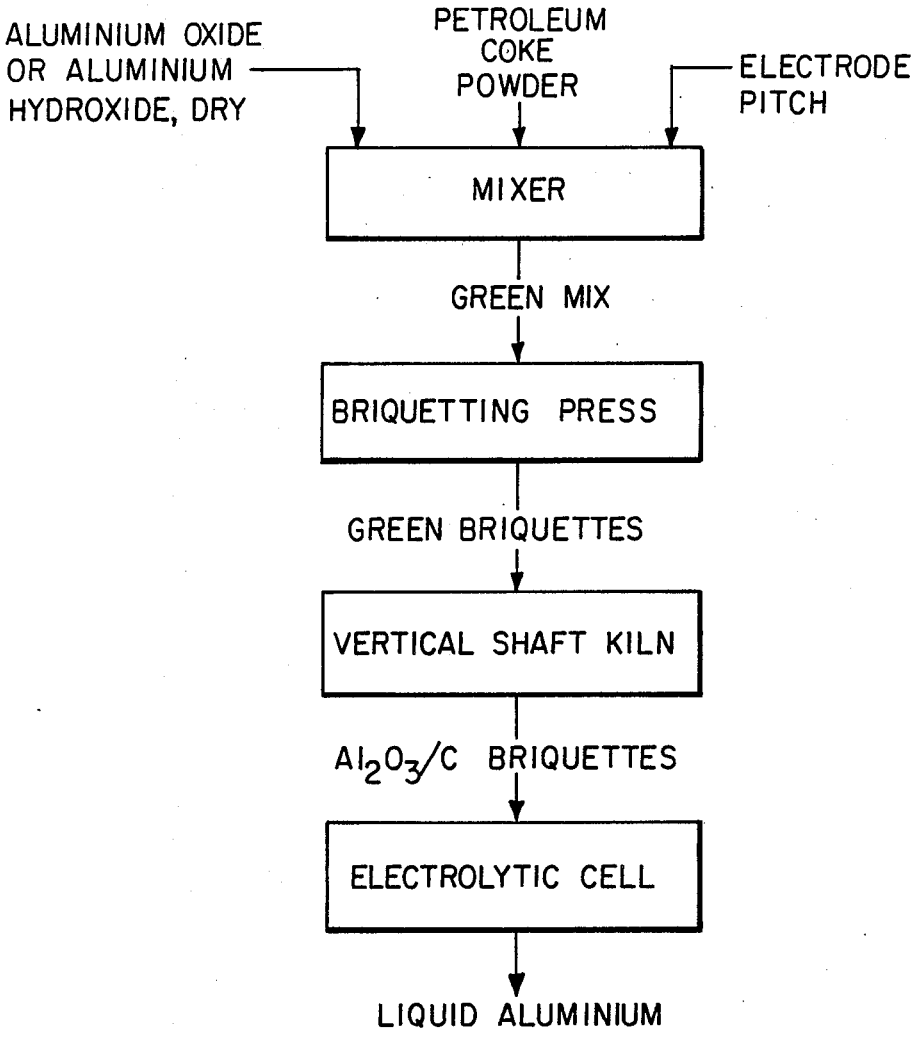
FIG. 7 is a schematic flow sheet of the aluminum production process of the present invention.

A process flow sheet schematic for manufacturing agglomerated feed material from $Al_2O_3$ and carbon is depicted in FIG. 7. The individual stages of this process are to be regarded as examples and are replaceable by alternative process stages. Thus, for instance, the vertical kiln can be replaced by a tunnel kiln. If the flow chart of FIG. 7 is compared with the preparatory operations required for the raw materials and auxiliary materials for the two known processes mentioned initially, the process which is the subject of this invention demonstrates important advantages in engineering energy saving.

I claim:

1. The process of producing aluminum from aluminous material by molten salt electrolysis in a cell having anodic and cathodic bodies and an electrolyte including an aluminum halide salt at a temperature above the melting temperature of aluminum, comprising the steps of:

(a) providing a mixture of aluminous material and a carbon source with a conductor of higher conductivity than the mixture, (b) providing a bipolar electrode with two surfaces respectively acting as cathode and anode, and covering the anode surface only with said mixture, (c) subjecting the mixture to electrolytic reaction to an anodic body reaction site in the electrolyte with said conductor extending below the electrolyte surface to convert the aluminous material to an aluminum ionic condition migratory through the electrolyte to the cathodic body and to convert carbon to a carbon oxide gas, (d) producing an electrolytic reaction at a temperature of the order of 680° to 850° C. for consuming at least part of the anodic body to produce aluminum and substantially $CO_2$ output products.

2. The processor as defined in claim 1, wherein more than 50% of the melt consists of a member selected from the group consisting of sodium chloride and potassium chloride.

3. The process as defined in claim 1, wherein more than 50% of the electrolyte consists of a member selected from the group consisting of sodium chloride and potassium chloride.

4. The process as defined in claim 1 wherein the electrolyte contains 10–40% of at least one member of the group consisting of cryolite, alkali fluorides and alkaline earth fluorides.

5. The process as defined in claim 4 further comprising conducting the electrolysis at a temperature of between about 680 and 850 degrees centigrade.

6. The process as defined in claim 5 which comprises adding a member selected from the group consisting of lithium chloride and alkaline earth chlorides to the electrolyte in quantities of between about 2 to 20%.

7. The process as defined in claim 6 which includes adjusting a proportion of aluminium chloride in the melt before the electrolysis commences to between about 3 and 5%.

8. The process as defined in claim 1 which comprises maintaining aluminum containing granules in contact with said non-consumable anode section which includes a permeable member which permits free passage of said electrolyte to said granules but prevents said granules from moving away from said anode region.

* * * * *